US005394596A

United States Patent [19]

Lindenmüller et al.

[11] Patent Number: 5,394,596

[45] Date of Patent: Mar. 7, 1995

[54] CARRIER FRAME FOR TRANSFERRING A LOOM HARNESS INTO A LOOM

[75] Inventors: Walter Lindenmüller, Lindau; Valentin Krumm, Hergensweiler, both of Germany; Rudolf Cresnik, St. Gallenkirch, Australia

[73] Assignee: Lindauer Dornier Gesellschaft mbH, Lindau, Germany

[21] Appl. No.: 221,408

[22] Filed: Mar. 31, 1994

[30] Foreign Application Priority Data

Apr. 2, 1993 [DE] Germany ..... 43 10 838.5

[51] Int. Cl.[6] ..... D03J 1/00

[52] U.S. Cl. ..... 28/208; 28/201; 139/1 R

[58] Field of Search ..... 28/201, 208, 209, 210, 28/211; 139/1 R

[56] References Cited

U.S. PATENT DOCUMENTS

| | | | |
|---|---|---|---|
| 1,304,846 | 5/1919 | Blair | 28/208 |
| 2,579,730 | 12/1981 | Eurey | 28/208 |
| 4,934,413 | 6/1990 | Yao | 139/1 R |

FOREIGN PATENT DOCUMENTS

| | | | |
|---|---|---|---|
| 1418823 | 10/1965 | France | 28/201 |
| 3523693 | 3/1986 | Germany | 28/208 |
| 4234563 | 4/1994 | Germany | 28/208 |

OTHER PUBLICATIONS

Genkinger Sale brochure.

Barber-Colman Company-Warp Transport Truck.

*Primary Examiner*—John J. Calvert

*Attorney, Agent, or Firm*—W. G. Fasse; W. F. Fasse

[57] ABSTRACT

A carrier frame for transferring a loom harness into a loom is equipped for carrying additional loom components such as selvage spools, leno spools, and a warp stop motion unit. Such a carrier frame is constructed to be adjustable in its longitudinal direction that extends crosswise to a movement direction of a transport cart to which the carrier frame is attached by centering elements, one of which is position adjustable in its position to adjust the carrier frame to different weaving widths. Two longitudinal beam members (6A, 6B) held in a guide and coupling member are adjustable crosswise to the frame width.

24 Claims, 8 Drawing Sheets

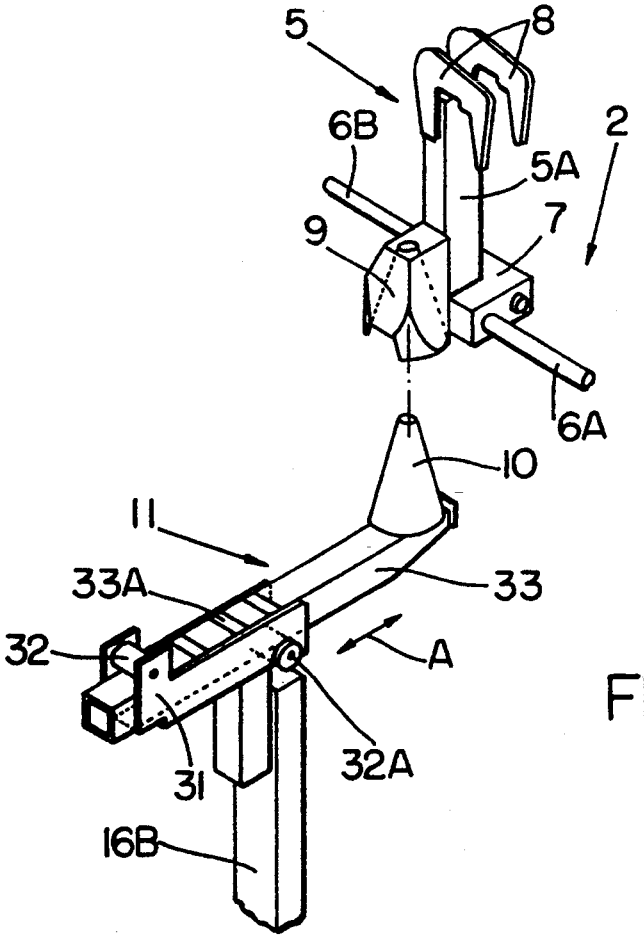
FIG. 4
FIG. 5
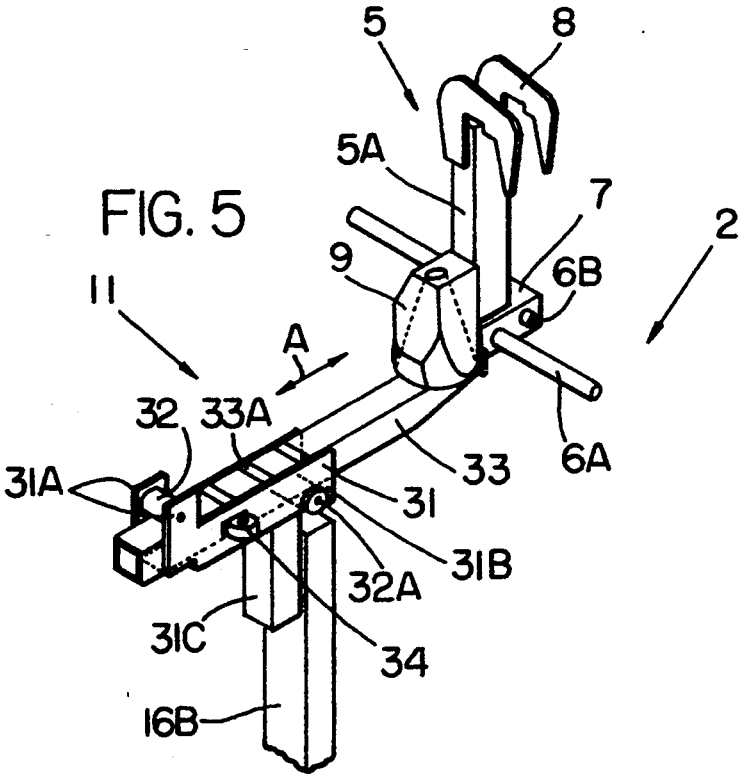

CARRIER FRAME FOR TRANSFERRING A LOOM HARNESS INTO A LOOM

CROSS-REFERENCE TO RELATED APPLICATION

The present application is related to application Ser. No. 08/136,385, filed on Oct. 13, 1993, for "AN APPARATUS FOR TRANSFERRING A WARP THREAD EXCHANGE SYSTEM INTO A LOOM".

FIELD OF THE INVENTION

In a warp thread exchange system for a loom, a carrier frame is supported on a transport cart in a releasable manner. The carrier frame supports the loom harness and/or other loom components and the carrier frame in turn is supported on the transport cart which permits moving thread filled loom components such as the loom harness carried on the carrier frame into a loom and to remove empty components from the loom.

BACKGROUND INFORMATION

The above mentioned copending application Ser. No. 08/136,385 which corresponds to German Patent Application P 4,234,563.4 describes an apparatus for transferring a warp thread exchange system into a loom. The carrier frame makes it possible that the loom harness with the drawn-in main warp can be taken over by a transport cart from which the loom harness is in turn removed by a warp beam lifting cart for insertion into the loom. However, there is room for improvement with regard to the insertion of selvage threads on selvage spools and leno threads on leno spools into the loom so that with each warp exchange or with each article change, it is also possible to draw-in the selvage threads and the leno threads in addition to the warp threads drawn into the loom harness. The insertion or draw-in of the selvage threads and of the leno threads has been performed heretofore directly in the loom after the loom harness with the inserted weft threads has been inserted into the loom. The draw-in or insertion of the selvage threads and of the leno threads directly in the loom, however, requires a substantial manual effort since it is time consuming. As a result, the start of the weaving with the newly inserted weft threads is delayed.

Another area of improvement involves the adjustment of the weaving width. In the above mentioned apparatus the weaving width is fixed, hence that apparatus cannot be universally used for loom harnesses having different widths.

Further, a plug-in connection between the carrier frame and the transport cart in the above mentioned apparatus also leaves room for improvement to provide for a smooth and rapid handling of the carrier frame when a loom harness is to be exchanged, while still permitting a precise positioning of the carrier frame.

OBJECTS OF THE INVENTION

In view of the above it is the aim of the invention to achieve the following objects singly or in combination:

- to construct the interface or rather the connection between a transport cart and a carrier frame for loom components in such a way that the carrier frame can be easily connected to the transport cart in a short time while still assuring the proper function of the entire system;
- to construct the carrier frame in such a way that it is useful for different types of loom harnesses and adjustable for different weaving widths;
- to avoid the insertion or threading-in of the leno threads into the respective leno weaving devices and of the selvage threads into the respective selvage weaving devices, after the loom harness has been inserted into the loom by permitting the threading-in or drawing-in of the leno threads and of the selvage threads already outside of the loom similar to the insert;
- to equip the carrier frame with devices for the holding and positioning of further loom components such as leno spools and selvage spools or the like; and
- to provide connectors between the carrier frame and the support cart which permit a rapid attachment of the carrier frame to the transport cart while simultaneously centering the frame on the cart and to also permit a rapid detachment of the frame from the cart.

SUMMARY OF THE INVENTION

The carrier frame according to the invention is characterized by an adjustable horizontal frame component and by a vertical frame component on which the horizontal frame component is adjustably supported. The horizontal frame component comprises at least a first pair of horizontal beam members and a second pair of horizontal beam members. The beam members of each pair are longitudinally adjustable relative to each other or rather in parallel to each other in a common horizontal plane, whereby the adjustment direction extends in parallel to the travel direction of a carrier cart to which the vertical frame component comprising at least two upright posts, is secured. The longitudinal length adjustment of the pairs of horizontal beam members may be accomplished by a telescoping feature between two beam members of a pair. Preferably, the beam members of a pair are slideably held in a guide and coupling member. A loom harness may be directly mounted on the horizontal beam members. Preferably, the horizontal frame component is equipped with harness mounting devices for supporting a loom harness in an exchangeable manner. Each pair of horizontal beam members carries a vertical load holder including a vertical stud secured with its lower end to the guide and coupling member and carrying at its upper end a load holding claw. Each pair of horizontal beam members is equipped with a first centering mounting member that cooperates with a second centering mounting member. The first centering mounting member is preferably secured to the guide and coupling member. The second centering mounting member is secured to a position adjustable positioning device for adjusting the weaving width of the carrier frame. Two positioning devices are provided one on each side. Each positioning device is adjustably mounted to the vertical frame component, more specifically to a respective upright post at least two of which are carried by the transport cart.

The carrier frame according to the invention is equipped with devices for holding and positioning the loom harness and with further devices for holding and positioning additional loom operational components such as the leno spools and the selvage spools. Thus, the threads for the selvage formation and the threads for the leno weave can be drawn-in outside the loom after the insertion of the main warp threads into the heddles.

The transport cart is equipped for supporting the carrier frame. For this purpose, each of the two upright posts mounted on the transport cart carries at its upper end one of the above mentioned position adjustable positioning devices for supporting the horizontal frame component of the carrier frame. The positioning devices are so constructed that they permit a universal adjustment of the carrier frame for different weaving widths. Each positioning device has a horizontal arm, one end of which is position adjustably mounted to the upper end of the respective vertical posts and the other end carries one of the centering mounting members forming part of a pair. The other centering mounting member of a pair is secured to the respective guide and coupling member of the horizontal frame component. The vertical posts in turn are mounted at their lower end to a respective mounting bracket secured to the transport cart. The mounting bracket simultaneously preferably forms a mount for the warp beam. The two horizontal arms of the position adjustable positioning devices extend perpendicularly to the movement direction of the transport cart and perpendicularly to the length of the longitudinally adjustable beam members of the horizontal frame component. The arms of the positioning devices are supported at the top of the vertical posts by rollers whereby these arms are axially displaceable in respective holders, whereby the displacement extends perpendicularly to the movement direction of the transport cart and perpendicularly to the length of the beam members forming part of the horizontal frame component.

The first and second centering members are preferably formed as conical or pyramid shaped elements. For example, one member may have a conical bore while the other member of a pair has a cone shape to fit into the conical bore. As mentioned, the centering member connected to the carrier frame is preferably secured to the guide and coupling member of the respective carrier frame section formed by the pair of beam members. When the cone or pyramid enters into a respective conical or pyramid shaped bore, the carrier frame is automatically centered relative to the transport cart. In the embodiment in which the centering members have a pyramid shape, an automatic locking against relative rotation between the carrier frame and the support arms is assured.

In order to protect a warp stop motion unit during its insertion and withdrawal into the carrier frame according to the invention, the connecting elements between the carrier frame and the warp stop motion unit are constructed as individual elastic elements that are sufficiently flexible relative to bending so that they can function as clips for snapping onto tubular members of the warp stop motion unit when the latter is inserted into the carrier frame and for snapping-off these tubular members when the warp stop motion unit is removed from the carrier frame. Each individual elastic connecting element includes a supporting portion and a holding portion. Each holding portion has an inner contour that matches the outer contour of the tubular member of the warp stop motion unit. Preferably, at least the holding portion of these clips is made of an elastic material. Thermoplastic synthetic materials have been found to be suitable for making at least the holding portion of these clips.

BRIEF DESCRIPTION OF THE DRAWINGS

In order that the invention may be clearly understood, it will now be described, by way of example, with reference to the accompanying drawings, wherein:

FIG. 4 illustrates a perspective view of the first and second centering and mounting members, whereby one centering and mounting member is secured to the carrier frame while the other centering and mounting member is secured to the respective position adjustable positioning device for the carrier frame, whereby both centering and mounting members are shown in their disengaged position;

FIG. 5 is a view similar to that of FIG. 4, but showing the two centering and mounting members in their mutually engaged position holding the carrier frame in a centered position on the upright posts;

DETAILED DESCRIPTION OF PREFERRED EXAMPLE EMBODIMENTS AND OF THE BEST MODE OF THE INVENTION

Figure 1:
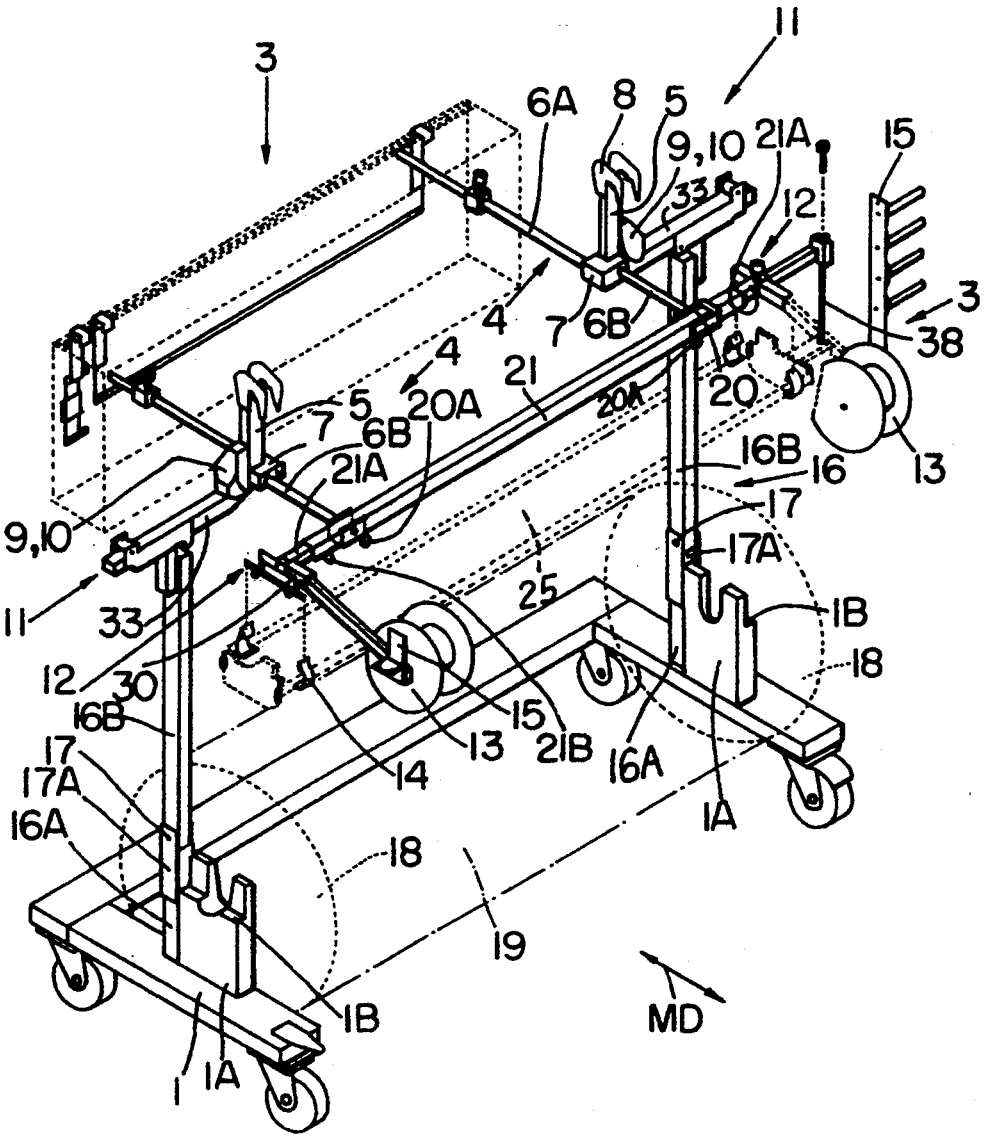
FIG. 1 is a perspective view illustrating a transport cart having attached thereto a carrier frame according to the invention, whereby some loom components carried by the frame are shown in dashed lines while other loom components are shown in full lines.

FIG. 1 is a perspective view of FIG. 1 of a transport cart 1 supporting a horizontally arranged carrier frame 2 according to the invention. The carrier frame 2 is supported by vertical posts 16 mounted on the cart 1. The horizontal carrier frame 2 comprises two sections 4 and a crossbeam 21. The sections 4 extend in parallel to each other and in parallel to the movement direction MD of the transport cart 1. Each frame section 4 comprises two horizontal beam members 6A and 6B longitudinally displaceable relative to each other namely in parallel to each other, for example by a telescoping feature or the two beam members 6A and 6B of a pair are slideably received in a guide and coupling member 7. The guide and coupling member 7 permits each pair of horizontal beam members 6A, 6B to be displaced axially in parallel to each other. The rear beam members 6A carry a loom component 3 shown in dashed lines since it is not part of the invention. The front beam members 6B are interconnected by the horizontal crossbar 21. The guide and coupling member 7 carries a vertical load holder 5 described in more detail below.

The structure of the transport cart 1 is described in more detail in the above mentioned U.S. patent application Ser. No. 08/136,385. A warp beam support 1A carrying a warp beam 19 shown in dashed lines, is mounted at each end of the cart 1. Each end of the warp beam 19 is formed by a respective warp beam disk 18. The vertical posts 16 may be considered to be part of the cart 1 or part of the carrier frame 2. Each vertical post 16 comprises a lower section 16A rigidly secured to the cart 1 and an upper section 16B connected to the lower section by a bracket 17A and a hinging bolt 17. Preferably, the supports 1A for the warp beam 19 and the lower post sections 16A are positioned centrally and next to each other on the cart ends as shown in FIG. 1. The upper post section 16B is tiltable about an axis formed by the bolt 17 that secures the lower end of the upper post section 16B to the bracket 17A. In its upright position the bolt is locked. The tilting axis defined by the bolt 17 is positioned in a plane that is preferably below the top point of the warp beam disks 18. Such a location of the axis 17 is important for the cooperation between the transport cart 1 and a heddling carriage of a warp heddling machine not shown.

FIG. 1 further shows that each upright post 16 carries at its upper end a position adjustable positioning device 11 for mounting the horizontal carrier frame 2. These positioning devices 11 will be described in more detail below with reference to FIGS. 4 and 5. The positioning devices 11 have horizontally adjustable arms 33 to vary their position as indicated by the arrow A in FIGS. 4 and 5 for adjusting the weaving width. By adjusting the weaving width, the present carrier frame 2 is capable of taking up loom harnesses of different widths from a heddling machine and to temporarily store such loom harnesses for a subsequent transfer of the heddled harness to a loom.

According to the invention, the carrier frame 2 is equipped to carry additional loom components such as a warp stop motion unit 25, selvage spools 13, and leno spool holders 15. The position of these components must also be adjustable to accommodate different weaving widths. For this purpose the carrier frame 2 carries position adjustable carrier structures 12 secured to at least one end, preferably to both ends of the crossbar 21. The crossbar 21 is held in brackets 20 that are secured to the forward ends of the beam members 6B. Locking devices 20A hold the crossbar 21 in the brackets 20. In the shown embodiment the crossbar 21 has telescoping extensions 21A held in place by lock screws 21B. These extensions 21A of the crossbar 21 make it possible to adjust the crossbar to different weaving widths.

The functional components 3 of a loom, such as the heddles, the reed, the warp stop motion unit 25, the leno spools carried by their holders 15, and the selvage spools 13 can now all be prepared outside the loom proper, so that these components 3 may be inserted into the loom ready for weaving. The preparation work, such as the heddling of the warp threads and the drawin of the selvage and leno threads is thus performed outside of the loom where this work can be done more efficiently than in the loom which can continue to weave while the preparation work is done outside the loom. For this purpose, the selvage spools 13, the leno spool holders 15, and the warp stop motion unit 25 are supported by the carrier frame 2 with the aid of the carrier structure 12. Each carrier device 12 has an extension arm 23 for mounting the selvage spools 13 and the leno spool holders 15. Additionally, the device 12 holds a suspension bar 30 for suspending the warp stop motion unit 25 by chains 51. This suspension of the unit 25 will be described in more detail below with reference to FIGS. 6 and 7.

Figure 2:
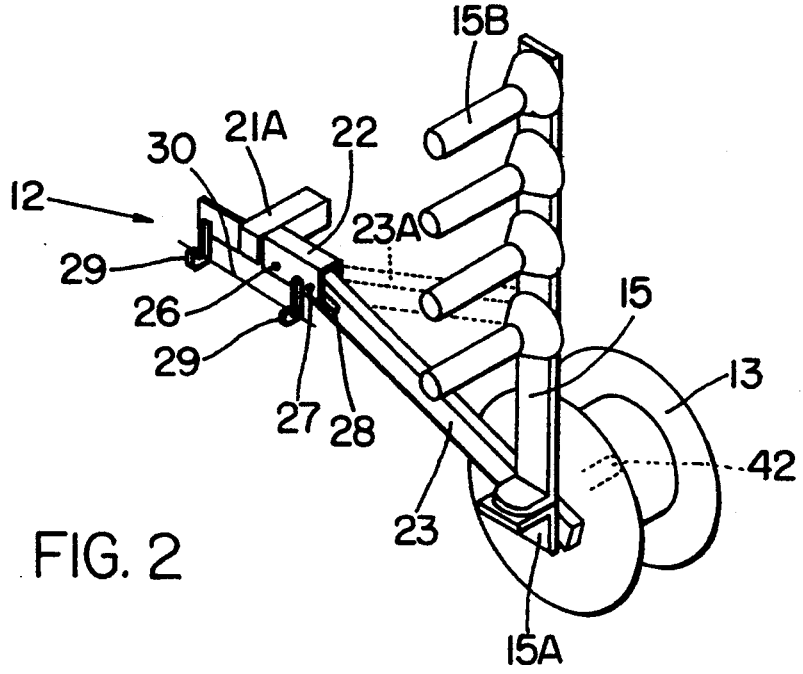
FIG. 2 shows a perspective view of a first support structure for securing the selvage spools and the leno spools to the carrier frame.

FIG. 2 shows a carrier structure 12 for mounting the selvage spool 13 and the leno spool holder 15 and for suspending the warp stop motion unit 25. A guide section 22 having a downwardly open U-cross-section is rigidly secured to the free end of the crossbar extension 21A. A position adjustable tilting arm 23 is mounted in the guide section 22. For this purpose, the left-hand end of the arm 23 has an elongated hole 28. A pin or bolt 27 rigidly secured in the side walls of the guide section 22 passes through the elongated hole 28 of the arm 23. In the full line position of the arm 23, the pin 27 bears against the left-hand end of the elongated hole 28, thereby permitting the tilting of the arm between the full line position and the dashed line position 23A. The top wall 22A of the guide section 22 is so spaced from the pin 27 that the tilting motion of the arm 23 is limited. A further cross pin 26 passes through the guide section 22 to limit the axial insertion of the arm 23 into the guide section 22. The pin 26 does not pass through the elongated hole 28. The selvage spool 13 is mounted on a spool shaft or mandrel 42 secured to the lower end of the arm 23 to permit rotation of the spool 13.

Figure 9:
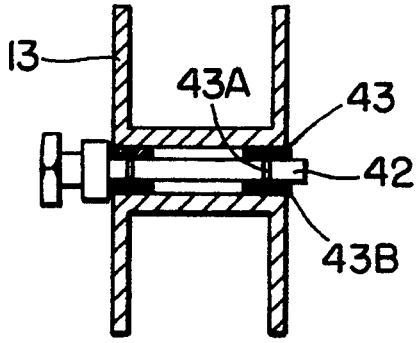
FIG. 9 is a sectional view through a selvage thread spool mounted on a mandrel provided with a permanent or rather continuously operating brake.

In a preferred embodiment shown in FIG. 9, the spool 13 is mounted on the spool shaft or mandrel 42 through a continuously effective brake element 43 which retards the rotation of the spool 13 just sufficiently to keep the selvage thread taut. The brake may, for example, comprise a rubber elastic ring 43 held in a circumferential groove 43A of the mandrel or shaft 42. The ring 43 frictionally engages the respective slide bearing 43B.

Referring further to FIG. 2, the leno spool holder 15 is secured at its lower end by a bracket 15A to the right-hand end of the arm 23. The holder 15 carries a plurality of leno spool mandrels 15B arranged in a row. Two suspension hooks 29 carrying the suspension bar 30 are also secured to the free end of the crossbar extension 21A as shown in FIG. 2 for suspending the unit 25.

Figure 3:
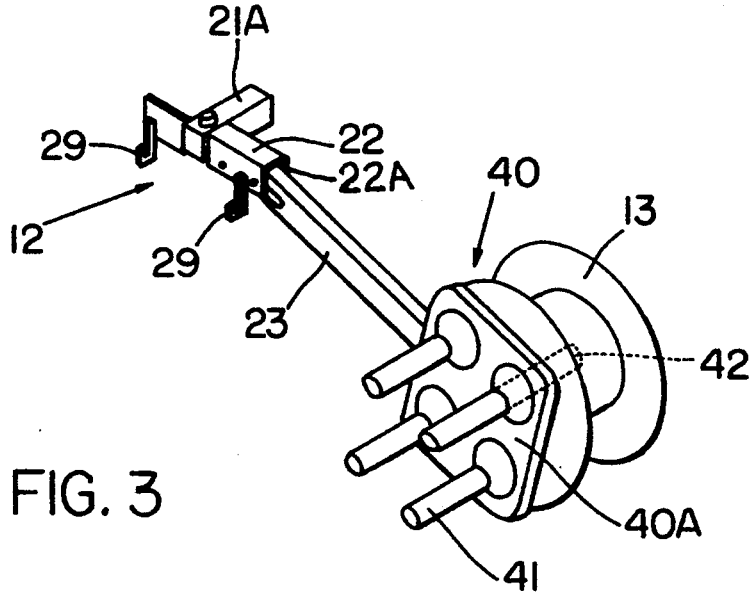
FIG. 3 is a perspective view similar to that of FIG. 2, but showing a second embodiment of a support structure for securing the selvage spools and leno spools to the present carrier frame.

In FIG. 3 the spool support structure 12 is the same as in FIG. 2. However, the leno spool carrier has been modified. The modified leno spool carrier 40 comprises a plate 40A carrying four leno spool mandrels 41 arranged at the corners of the substantially square plate 40A rather than in a row as shown in FIG. 2. Otherwise, the support structures of FIGS. 2 and 3 are the same.

Referring to FIGS. 4 and 5, the attachment of the carrier frame 2 to the position adjustable positioning devices 11 will now be described. The carrier frame 2 is connectable to the positioning device 11 by the cooperation of a first centering mounting member 9 and a second centering and mounting member 10. The first centering and mounting member 9 is rigidly secured to the guide and coupling member 7 while the second centering and mounting member 10 is rigidly secured to the free end of an arm 33 that is adjustable as indicated by the arrow A. In FIG. 4 the members 9 and 10 are still disengaged from each other. The member 9 is, for example, a socket with a conical bore or recess in which the conical member 10 is received as shown in FIG. 5. Instead of a conical recess and cone, these members could also have, for example, a pyramid shape. The embodiment with a pyramid shape provides simultaneously a mounting device that prevents relative rotation between the frame 2 and the arm 33. However, even the conical members 9, 10 can be provided with a fastened surface portion as a lock against relative rotation.

The above mentioned vertical load holder 5 comprises a vertical stud 5A rigidly secured at its lower end to the guide and coupling member 7 and carrying at its upper end one, preferably two claws 8 described in more detail below with reference to FIGS. 8A and 8B.

The position adjustable positioning device 11 in FIGS. 4 and 5 comprises a mounting bracket 31 having an upwardly open U-cross-section in which an adjustable arm 33 is slideably received for back and forth movement as indicated by the arrow A. The arm is preferably cut from a closed box section. The bracket 31 is provided at its left-hand end with two upwardly reaching ears 31A having rotatably mounted therein a guide roller 32. Similarly, the right-hand end of the bracket 31 has two downwardly reaching ears 31B carrying a further guide roller 32A. The guide rollers 32, 32A are so positioned that they contact the upwardly and downwardly facing surfaces of the arm 33. At least one, preferably two, lateral roller 34 with a vertical rotational axis is carried by the bracket 31 and extends through the side wall of the bracket 31 into contact with the side walls of the arm 33 to guide the arm 33 in the lateral direction. The bracket 31 is secured to a stud 31C which in turn is rigidly secured to the upper end of the post 16B, for example, by screws not shown.

Prior to loading the frame 2, the adjustment of the weaving width is accomplished by lifting the arm 33 and then pushing it either in one or the other direction as indicated by the arrow A. If desired, grooves 33A may be provided in the upwardly and downwardly facing surfaces of the arm 33 for-engagement by the rollers 32, 32A. However, the weight of the loaded frame 2 will hold the arms 33 in the proper adjusted position, even without such grooves 33A. The extensions 21A of the crossbar 21 are also adjusted to the same weaving width as the arms 33.

Figure 6:
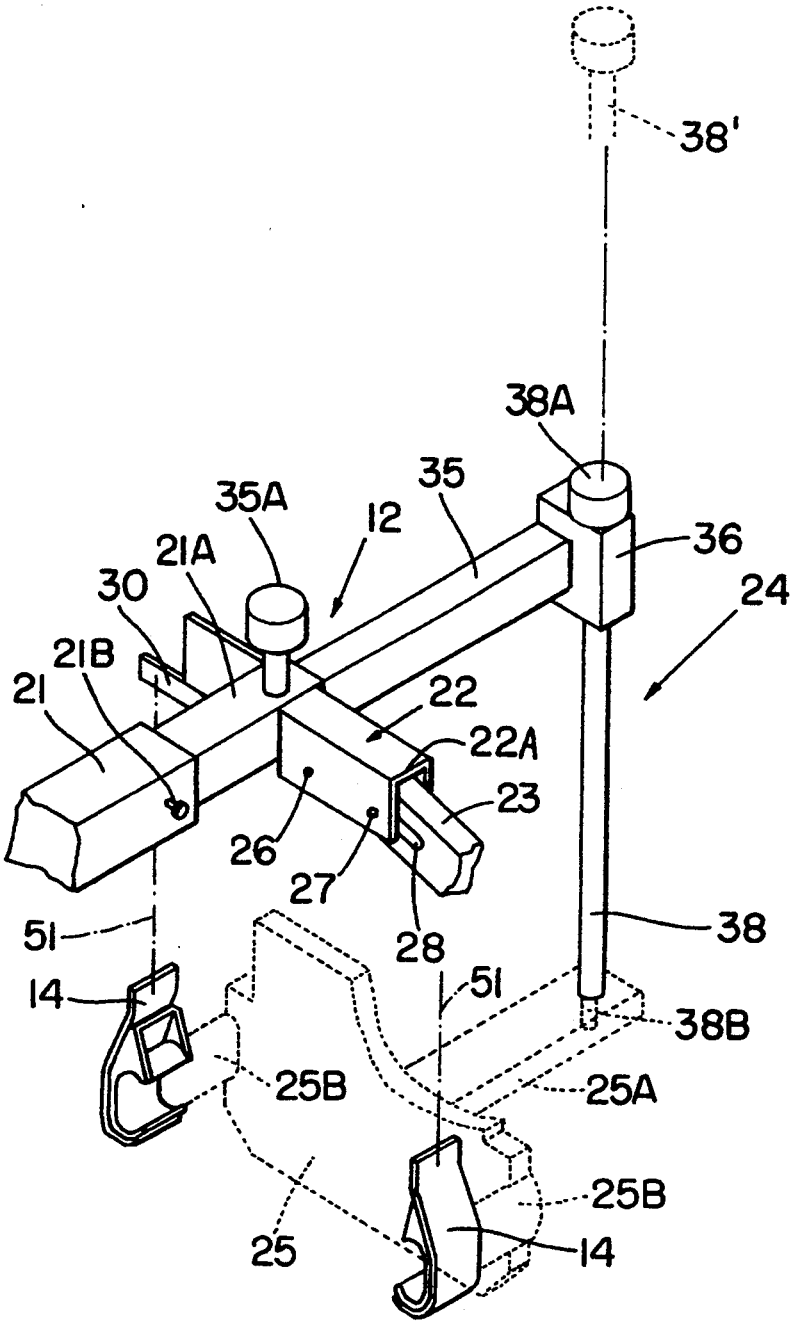
FIG. 6 is a perspective view of an adjustable device with a threaded bolt for fixing the position of a warp stop motion unit carried by the present carrier frame, whereby the device in its full line position holds the warp stop motion unit in a fixed position while the dashed line position illustrates the withdrawn position of the adjustable device.

FIG. 6 shows the right hand mounting or carrier structure 12 and a position locking device 24 for securing the warp stop motion unit 25 in a fixed position. The position locking device 24 comprises a threaded bolt 38 that has a tool or manually operable head 38A at its upper end and an engagement tip 38B at its lower end reaching into a bore of an extension 25A rigidly secured to the warp stop motion unit 25. In the full line position of the bolt 38, the unit 25 is held in a fixed position. The unit 25 is merely suspended by chains 51 when the bolt 38 is in the dashed line upwardly withdrawn position 38'. The bolt 38 is threaded through a threaded hole in a guide bushing 36 that is rigidly connected to an extension arm 35 which in turn is slideably received in the extension 21A of the crossbar 21. The axial position of the extension 21A in the crossbar 21 can be locked by the locking device 20A, such as a set screw or the like as mentioned above. The axial position of the extension arm 35 in the extension 21A can be arrested by a set screw 35A. When the set screws 20A and 35A are released, an axial adjustment is possible of the extension 21A telescoping inside the crossbar 21 and of the arm 35 telescoping inside the extension 21A. When the proper adjustment has been achieved, the set screws 20A and 35A are tightened.

Referring further to FIG. 6, the warp stop motion unit 25 is suspended by the chains 51 from the crossbar 30 secured to or held by the mounting or carrier device 12. The upper chain ends are fixed to the crossbar 30 and the lower chain ends hold tubular members 25B of the warp stop motion unit 25 with the aid of clips 14 to be described in more detail below with reference to FIG. 10. As shown in FIG. 6, the position locking device 24 is located at the right-hand end of the crossbar 21. However, an additional corresponding locking device may be arranged mirror-symmetrically also at the opposite, left-hand end of the crossbar 21 as viewed in FIG. 1.

Figure 7:
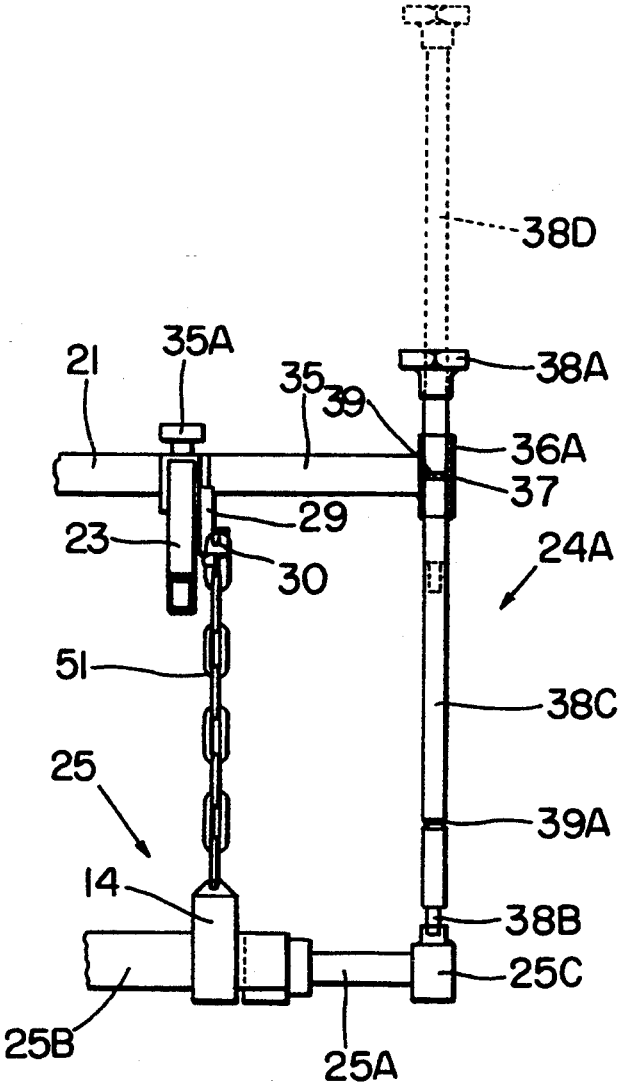
FIG. 7 is a side view of a modified adjustable device with a snap for fixing the position of a warp stop motion unit, whereby the full line position indicates the fixing position while the dashed line position indicates the withdrawn position of the fixing device.

FIG. 7 shows a side view of a modified position locking device 24A for the warp stop motion unit 25. The device 24A uses a stop rod 38C rather than a threaded rod 38. The stop rod 38C is provided with ring grooves 39 and 39A. The stop rod 38C has also a tip 38B engaging a bushing 25C connected to the extension 25A of the unit 25. The stop rod 38C is received in a clamping bushing 36A provided with a spring elastic clamping ring 37 for engaging one of the two ring grooves 39 or 39A. As shown, the clamping ring 37 engages the groove 39 thereby holding the stop rod 38C in the full line position fixing the unit 25. When the elastic spring force of the clamping ring 37 is overcome by pulling the rod 38C upwardly into the dashed line position 38D the rod 38C can slide inside the bushing 36A until the groove 39A is engaged by the ring 37. In the dashed line position 38D the unit 25 is not fixed but merely suspended by the chains 51 from hooks 29 or from the crossbar 30. In FIG. 7 the extension arm 35 slides directly inside the crossbar 21. In all instances it is preferred that the crossbar 21, its extension 21A, and the arm 35 are hollow box profiles dimensioned to telescope one within the other for the adjustment of the weaving width.

Figures 8A, 8B:
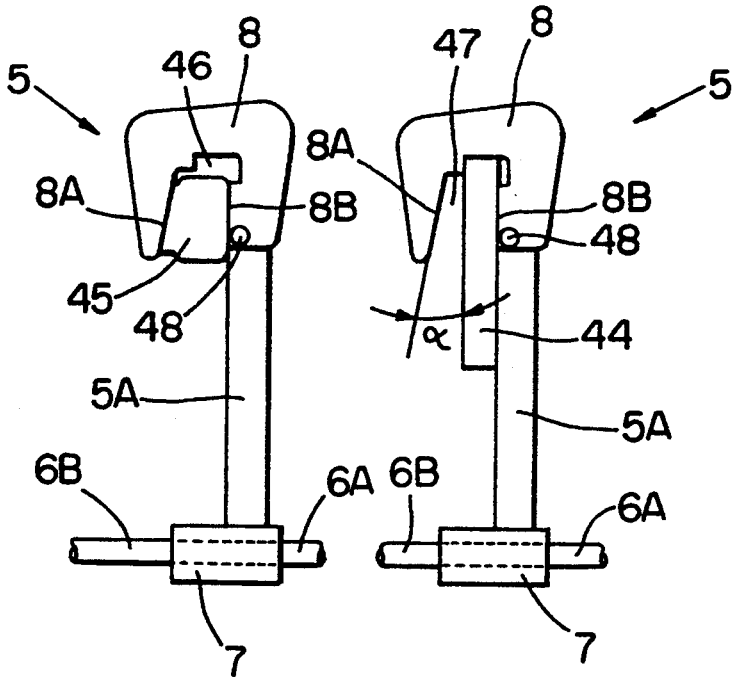
FIGS. 8A and 8B show side views of a load holding claw having a sectional claw configuration for engaging carrier elements having different sectional profiles.

FIGS. 8A and 8B each show a side view of the vertical load holder 5 illustrating the cross-section of the claw 8 carried at the top of a vertical stud 5A. The claw 8 has such a profile configuration that it can be connected to two different carrier elements 44 or 45 at different times. In both instances, a form-locking connecting of the respective carrier element 44 or 45 by the claw 8 or claws is assured. For this purpose, the claw 8 forms a first recess 47 configured to engage the element 45 in a formlocking manner and a second recess 46 configured to engage the element 44 in a formlocking manner. Both figures also show that an inwardly facing portion of the claw 8 forms a lead-in ramp 8A for engaging a respective sloping surface of the element 45. Further, the claw has a vertical stop surface 8B that engages both elements 44 and 45. However, the lead-in ramp 8A does not engage the element 44. The lead-in ramp 8A encloses with the vertical an angle $\alpha$ which is selected in accordance with the cross-sectional profile of the element 45. The claw 8 is secured to the upright or vertical stud 5A for example by a pin 48 so that it is possible to easily exchange the claws 8, for example, against claws having another cross-sectional configuration or to replace worn out claws against new ones. Each claw is capable of holding at least two different elements 44, 45. The lower end of each stud 5A is rigidly secured to the respective guide and coupling member 7 as described above. The carrier element 44 is, for example, part of a heddling machine in which the carrier frame 2 is inserted with its loom harness for the heddling operation. The element 45 is, for example, part of a warp beam lifting carriage which takes over the carrier frame 2 with the loom harness from the transport cart 1 for transfer of the loom harness into a loom not shown.

Incidentally, the pin 48 is preferably rotatable by a tool in order to counteract any tendency of the element 44 or 45 to become wedged in the claw 8. Thus, the pin 48 performs two functions to hold the claw on the stud 5A and to prevent a wedging action.

Figure 10:
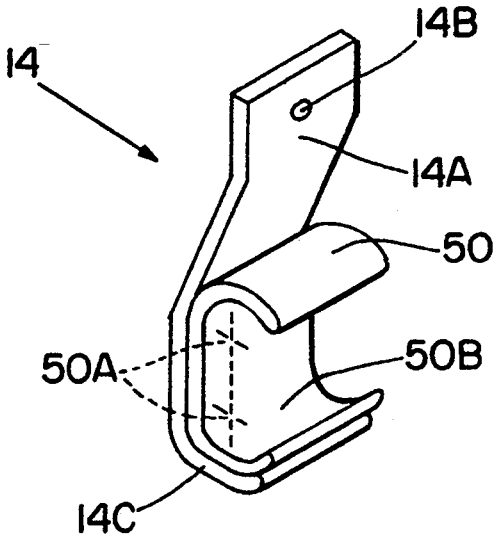
FIG. 10 is a perspective view of a connector element constructed at least partly as an elastic clip for securing a warp stop motion unit to the present carrier frame.

FIG. 10 shows a perspective view of a clip 14 for attachment to the tubular members 25B of the warp stop motion unit 25 shown in FIG. 6. Each clip 14 comprises a support portion 14A which is relatively stiff against bending and a clip-on portion 50 which is relatively flexible for clipping onto the tubular members 25B. The support portion 14A has at its upper end a connector element 14B to which the lower end of the chain 51 is connectable. The lower end 14C of the support portion 14A forms a saddle on which the clip portion 50 rests. The clip-on portion 50 is additionally secured, for example, by rivets 50A the outer surface of the tubular members 25B. The clip-on portion 50 is further preferably made of a flexible, elastic material such as thermoplastic synthetic material. The clip 14 can be connected to the tubular members 25B in a clip-on fashion so that an easy attachment to the frame 2 and quick removal of the warp stop motion unit 25 from the frame 2 is assured.

Referring again to FIG. 1, the warp beam supports 1A are provided with shoulders 1B that provide a stop and a rest for the respective upper post section 16B when these post sections 16B are in their downwardly tilted position. The shoulders 1B and the respective hinging bolt 17 are preferably so positioned relative to each other that the tilting of the upper post sections 16B is limited to an angle of about 90°.

Figure 11:
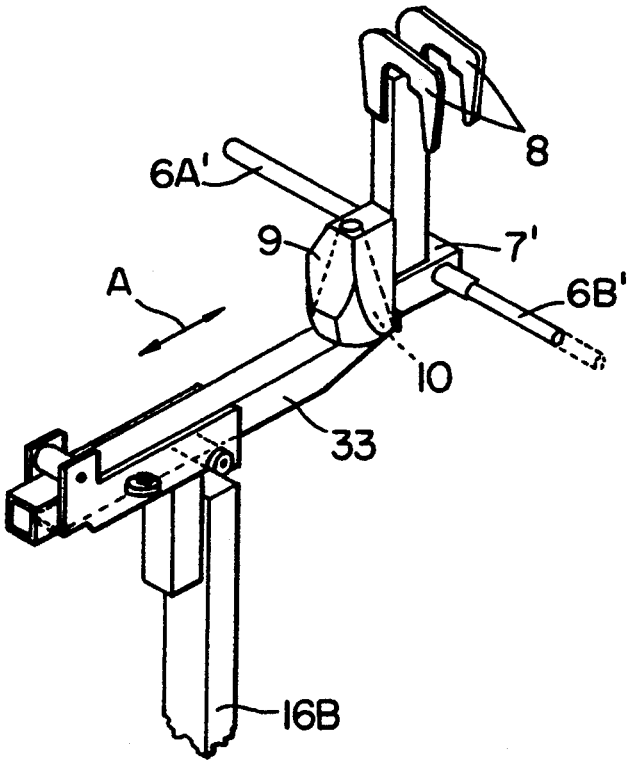
FIG. 11 shows telescoping beam members of the present carrier frame.

FIG. 11 shows a view similar to that of FIG. 5, but with a modified guide and coupling member 7' that guides horizontal beam members 6A' and 6B' as telescoping elements that are positionable by a coaxial displacement rather than by a parallel displacement as in FIGS. 4 and 5.

Although the invention has been described with reference to specific example embodiments, it will be appreciated that it is intended to cover all modifications and equivalents within the scope of the appended claims.

What is claimed is:

1. A carrier frame for transferring loom components (3, 13, 15, 25) into a loom on a transport cart (1) to which the carrier frame (2) is connectable, comprising two pairs of first and second horizontal beam members (6A, 6B) arranged in a common plane and at least one vertical post (16) connected to each respective pair of horizontal beam members, each vertical post being connectable to said transport cart, said carrier frame (2) further comprising loom component mounting elements (12, 21, 23) for connecting said loom components (3, 13, 15, 25) to said carrier frame (2), and position adjustable positioning devices (11, 33) for connecting said pairs of beam members (6A, 6B) to said vertical posts (16), a guide and coupling device (7) for each of said pairs of horizontal beam members (6A, 6B) for holding the beam members in said common plane and so that the beam members (6A, 6B) are longitudinally adjustable in positions relative to each other, a load holder (5) secured to each of said guide and coupling devices (7), said carrier frame (2) further comprising first centering members (9) and wherein said position adjustable positioning devices (11, 33) comprising second centering members (10) for cooperation with said first centering members (9) for releasably holding said carrier frame (2) on said vertical posts (16), each of said position adjustable positioning devices (11, 33) further comprising an adjustable arm (33) for adjusting a weaving width of said carrier frame (2).

2. The carrier frame of claim 1, wherein said guide and coupling device (7) comprises two parallel through holes in which said first and second horizontal beam members (6A, 6B) are slideably held.

3. The carrier frame of claim 1, wherein said guide and coupling device (7) comprises one through hole in which said beam members of a pair are received in a telescoping manner.

4. The carrier frame of claim 1, wherein said loom component mounting elements comprise a mounting device (12) secured to a free end of one of the beam members (6B) of each of the beam members pairs, said mounting device (12) comprising means for holding a selvage spool (13), a warp stop motion unit (25), and a leno spool holder (15).

5. The carrier frame of claim 4, wherein said mounting device (12) comprises a clip (14) including a support portion (14A) and a holding portion (50) having an inner contour corresponding to an outer contour of an elongated support element (25B) of the warp stop motion unit (25), said holding portion (50) being made of an elastic material and having a surface coating (50A) for protecting said elongated support element (25B) of said warp stop motion unit (25).

6. The carrier frame of claim 5, wherein said holding portion (50) has a C-cross-sectional configuration with elastic C-legs forming a clip for elastic clip-on connection with said elongated support element (25B).

7. The carrier frame of claim 5, wherein at least said holding portion (50) is made of a thermoplastic synthetic material.

8. The carrier frame of claim 4, wherein said mounting device (12) comprises a telescoping crossbar (21) and brackets (20) securing said crossbar (21) to the free beam member ends, said brackets are fixed against rotation, said crossbar (21) comprising at a free end a guide bracket (22) extending at a right angle to said crossbar (21) and a support arm (23) secured to said guide bracket (22) for tiltable adjustment and arresting of said arm (23) for carrying the selvage spool (13) and the leno spool holder (15), said mounting device (12) further comprising at least one position locking device (24) for said warp stop motion unit (25).

9. The carrier frame of claim 8, wherein said position locking device (24) comprises an extension arm (35) forming a telescoping linear extension of said crossbar (21), said extension arm (35) comprising a guide bushing (36) at the free end of said extension arm (35), said position locking device (24) further comprising a locking bolt (38C), said guide bushing (36) comprising an integrated clamping element (37) for guiding and arresting said locking bolt (38C), said locking bolt having an extension (38B) at an end facing said warp stop motion unit (25) for locking the unit (25) in a fixed position.

10. The carrier frame of claim 9, wherein said locking bolt (38) comprises two ring grooves (39, 39A) into which said clamping element (37) engages when the fixing bolt (38) is in a rest position or in a locking position.

11. The carrier frame of claim 8, further comprising a mounting plate (40) secured to a free end of said support arm (23), and wherein said mounting plate (40) comprises spool mandrels (41, 42) extending from both sides of said mounting plate (40), (FIG. 3).

12. The carrier frame of claim 11, wherein said spool mandrels (41, 42) comprise at least one brake element (43) for permanently applying a braking action to the spools for keeping respective threads taut.

13. The carrier frame of claim 8, wherein said position locking device (24) comprises an extension arm (35) forming a telescoping linear extension of said crossbar (21), said extension arm (35) comprising a bushing (36) at the free end of said extension arm (35), said bushing comprising a threaded through hole, said position locking device (24) further comprising a threaded locking bolt (38), passing through said threaded through hole for engaging and arresting said locking bolt (38), said locking bolt having an extension (38B) at an end facing said warp stop motion unit (25) for engaging and locking said unit (25) in a fixed position.

14. The carrier frame of claim 8, wherein said guide bracket (22) comprises a downwardly open U-cross-sectional profile and comprising means for providing a stop against tilting of said support arm (23).

15. The carrier frame of claim 14, wherein said means for providing said stop against tilting comprise two stop pins (26, 27) extending through side walls of said guide bracket (22), whereby one pin (27) positioned near an open end of said guide bracket (22) guides said support arm (23) by passing through an elongated hole (28) in said support arm (23).

16. The carrier frame of claim 8, further comprising a suspension rod (30) and holders (29) arranged on an outer wall of said guide bracket (22), wherein the rod and holders carry said warp stop motion unit (25).

17. The carrier frame of claim 1, wherein each of said position adjustable positioning devices (11) for adjusting the weaving width of the carrier frame (2) is connected to a free end of an upper section (16B) of said upright post (16), said upper post section (16B) being tiltably journalled to a journal axis (17) for tilting through an angular range of 90°.

18. The carrier frame of claim 17, wherein said journal axis (17) of said upper post section (16B) is positioned in a vertical plane below the highest point of a warp beam disk (18) of a warp beam (19) positioned on said transport cart (1).

19. The carrier frame of claim 1, wherein each position adjustable positioning device (11) comprises a guide and mounting bracket (31) having a U-shaped section substantially open in an upward direction, a positioning arm (33) slideably received in said mounting bracket (31), and guide rollers (32, 32A) mounted in said mounting bracket (31) at respective end areas in such positions that said rollers (32, 32A) contact said positioning arm alternately at opposite sides thereof, said rollers functioning as bearings for said positioning arm guided between the rollers (32, 32A), said second centering member (10) being arranged at an end of said positioning arm (33) extending toward said carrier frame (2), said second centering member (10) cooperating with said first centering member (9) for holding said carrier frame.

20. The carrier frame of claim 19, further comprising at least one lateral guide roller (34), whereby said positioning arm (33) is guided in a horizontal plane by said lateral guide roller (34).

21. The carrier frame of claim 19, wherein said positioning arm (33) is displaceable between said rollers (32, 34) in a continuous stepless manner or in a stepped manner.

22. The carrier frame of claim 1, wherein said load holder (5) comprises a claw (8) and a vertical stud (5A), said claw (8) being arranged at an upper free end of each vertical stud (5A) of said carrier frame (2), said claw (8) having an inwardly facing contour for connecting, at different times to a carrier element (44) of a heddling machine or to a carrier element (45) of a warp beam lifting carriage.

23. The carrier frame of claim 22, wherein said inner contour of said claw (8) forms a first seat (46) and a second seat (47) including a lead-in ramp (8A), and wherein a stop surface (8B) positioned opposite said lead-in ramp (8A) comprises a pin (48) providing contact between the carrier elements (44, 45) and the stop surface (8B) for avoiding a wedging action.

24. The carrier frame of claim 22, wherein said lead-in ramp has a lead-in angle $\alpha$ larger than 3° relative to the vertical.

* * * * *

UNITED STATES PATENT AND TRADEMARK OFFICE

CERTIFICATE OF CORRECTION

PATENT NO. : 5,394,596

DATED : March 7, 1995

INVENTOR(S) : Lindenmüller et al.

It is certified that error appears in the above-indentified patent and that said Letters Patent is hereby corrected as shown below:

On the Title page, item [75]:

the third inventor's residence should read:

--St. Gallenkirch, Austria--.

Signed and Sealed this

Fourth Day of July, 1995

Bruce Lehman

*Attest:*

BRUCE LEHMAN

*Attesting Officer*

*Commissioner of Patents and Trademarks*